United States Patent [19]

Hall

[11] 4,454,449

[45] Jun. 12, 1984

[54] PROTECTED ELECTRODES FOR PLASMA PANELS

[75] Inventor: Stacy W. Hall, Colorado Springs, Colo.

[73] Assignee: NCR Corporation, Dayton, Ohio

[21] Appl. No.: 394,005

[22] Filed: Jun. 30, 1982

Related U.S. Application Data

[63] Continuation of Ser. No. 164,853, Jun. 30, 1980, abandoned.

[51] Int. Cl.[3] ..... H01J 17/49

[52] U.S. Cl. ..... 313/584; 313/586; 313/587

[58] Field of Search ..... 313/217, 218, 518, 355, 313/584, 586, 587

[56] References Cited

U.S. PATENT DOCUMENTS

| | | | |
|---|---|---|---|
| 3,716,742 | 2/1973 | Nakayama et al. | 313/182 |
| 3,775,764 | 11/1973 | Gaur | 340/324 R |
| 4,027,197 | 3/1977 | Coleman | 315/169 TV |
| 4,053,804 | 10/1977 | Aboelfotoh | 313/218 |
| 4,340,840 | 7/1982 | Aboelfotoh et al. | 313/584 X |

FOREIGN PATENT DOCUMENTS 2250821 5/1973 Fed. Rep. of Germany .

*Primary Examiner*—Eugene R. Laroche
*Assistant Examiner*—Vincent De Luca
*Attorney, Agent, or Firm*—J. T. Cavender; Casimer K. Salys; T. Rao Coca

[57] ABSTRACT

A metal oxide coating is applied between the conductive base and the magnesium oxide dielectric of the input and/or erase electrode(s) in a plasma display device to prevent break-down of the dielectric.

2 Claims, 5 Drawing Figures

PROTECTED ELECTRODES FOR PLASMA PANELS

This is a continuation of application Ser. No.164,853 filed June 30, 1980, now abandoned.

BACKGROUND OF THE INVENTION

This invention relates to plasma display devices, and more particularly, to protected electrodes for such devices.

Plasma or gaseous discharge devices are exemplified in U.S. Pat. No. 3,775,764, issued Nov. 27, 1973, to Jai P. Gaur; and U.S. Pat. No. 3,781,600 issued Dec. 25, 1973, to William E. Coleman and Clarence W. Kessler, both of which are assigned to NCR Corporation, the assignee of the present invention. Both of these patents are incorporated by reference herein.

Gaseous discharge devices which utilize the tranfer of trapped charges resulting from the discharge are now well known. In the physical construction of a device using this principle, an ionizable gas is contained within an enclosure which has a plurality of dielectric-coated transfer electrodes arranged parallel but offset from one another on opposite side walls thereof. The transfer electrodes are capacitively coupled to the ionizable gas by their dielectric coating. Typically, information is entered into the device via an input electrode which does not have the capacitive-coupling dielectric coating and is, thus, direct-coupled to the ionizable gas. That is, the device is serially addressed by applying a voltage of predetermined magnitude between the direct-coupled input electrode and the first or nearest opposite dielectriccovered transfer electrodes. These two electrodes form the first cell within the device. By the proper application of a potential on the electrodes, the gas in the cells, formed by successive pairs of nearest adjacent, opposite electrodes, is discharged and electric charge trapped on the coated walls of the electrode is used to transfer this gaseous discharge throughout the length of the device. Typically, information is erased via an erase electrode directly-coupled to the ionizable gas.

Typically, all the electrodes including the direct-coupled input and erase electrodes are coated with a thin layer of dielectric such as magnesium oxide for obtaining the characteristics of low operating voltage and stable life of the device. Unfortunately, contamination of the thin magnesium oxide coating over the input and erase electrodes frequently occurs due to sputtering of the electrode material during the heat treatment stage of manufacture of the panel. Similar contamination occurs also as the result of plasma discharge during use. Both sources of contamination alter the operating characteristics of the panel. Gold or gold alloy input and erase electrodes have stable life characteristics. The use of gold, however, has the disadvantage of high cost, and, because the transfer electrodes are not of gold, also requires the precise alignment of the separate input, erase and transfer electrode screenings.

The present invention provides a simple and economical solution to these problems.

SUMMARY OF THE INVENTION

It is an object of the invention to eliminate use of gold as electrode material.

It is yet another object of the present invention to use the same conductive material for forming the input electrode, the erase electrode, and the transfer electrodes.

It is a further object of the present invention to provide a plasma discharge panel wherein the input and erase electrodes are provided with a protective metal oxide coating so as to preserve the voltage and stability characteristics over the life of the panel.

It is a further object of the present invention to eliminate alignment of the input and erase electrodes with the other electrodes by forming all the electrodes from the same material.

The present invention is an improved electrode for use in plasma discharge display devices which generally contain at least one channel, formed as an envelope wherein an ionizable gas is held. A plurality of transfer electrodes are positioned sequentially and offset from one another along opposite surfaces of each channel and capacitively coupled to the gas. An input electrode is provided, typically one for each channel, and is located proximate the nearest transfer electrode such that a selected potential occurring between the input electrode and the nearest transfer electrode will initiate a plasma discharge within the channel. The present improvement in the aforementioned system is the provision of a protective, metal oxide coating on the input electrode which prevents dielectric breakdown of the electrode and thus preserves the operational characteristics of the device.

In a preferred embodiment, the metal oxide coating material is a commercially available ruthenium oxide resistor paste. This coating on the input electrode not only permits direct coupling of the input electrode with the ionizable gas but also allows use of the same conductive base for the input and transfer electrodes and thereby eliminates the additional processing step of aligning a separately formed input electrode with the other electrodes. The metal oxide coating can also be applied over the erase electrode. This coating on the erase electrode, like its counterpart on the input, preserves the operational characteristics of th plasma charge transfer device.

DESCRIPTION OF THE PREFERRED EMBODIMENT

Figure 2:
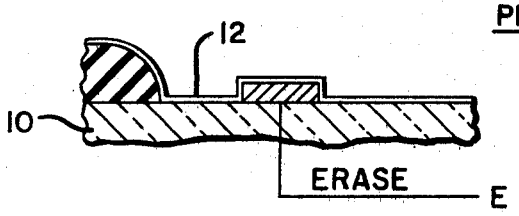
FIG. 2 PRIOR ART
FIG. 2 is a schematic cross-sectional view of a conventional direct-coupled erase electrode in a plasma charge transfer display device.
Figure 5:
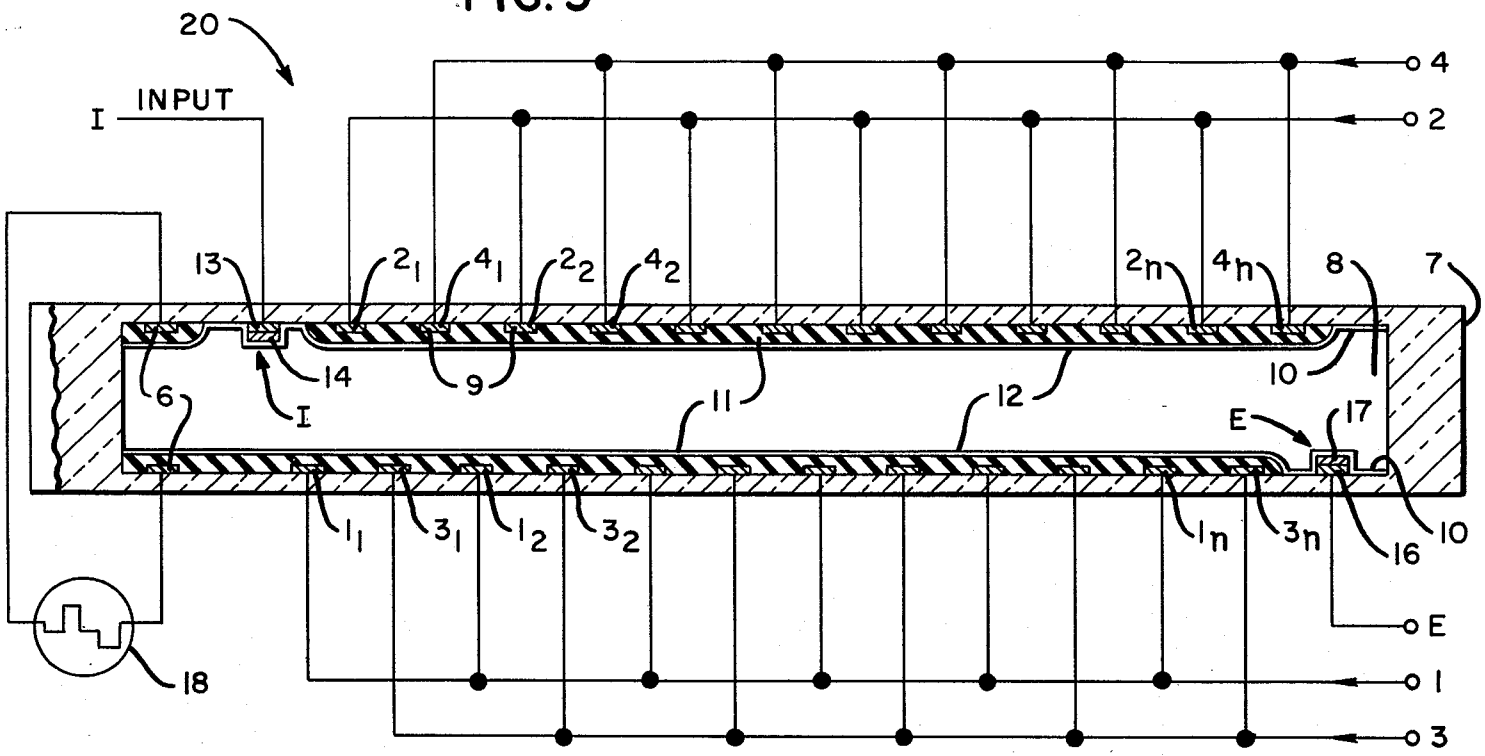
FIG. 5 is a schematic cross-sectional view of a plasma charge transfer display device embodying the principles of the present invention in the form of protective dielectric coatings on the input and erase electrodes.

FIG. 5, which is based upon FIG. 2 of U.S. Pat. No. 3,775,764 to Jai P. Gaur, is a cross-sectional representation of a plasma display panel 20 suitable for incorporating the improvements of the present invention. The display panel comprises enclosure or substrate 7 of any suitable dielectric material, such as a relatively thin, flat clear glass plate, defining a channel 8 containing an ionizable gas, such as neon and hydrogen, at a predetermined pressure. The display panel is provided with a pair 6—6 of keep-alive electrodes on the inner opposite walls 10—10 of the substrate, opposite one another, an input electrode I and an erase electrode E. A plurality of electrodes 9 identified as $1_1$, $2_1$, $3_1$, $4_1$ etc. to $1_n$, $2_n$, $3_n$, $4_n$ are located on the inner walls 10—10 of the substrate, opposite one another, in parallel alignment but laterally offset to subject the ionizable gas to an electric field when a suitable potential is applied between two nearest-adjacent opposite electrodes. Each succeeding pair of opposite nearest-adjacent electrodes (e.g., I–$1_1$, $1_1$–$2_1$, $2_1$–$3_1$, $3_1$–$4_1$, $4_1$–$1_2$, etc.) forms a cell. In the embodiment shown, all the electrodes except the input electrode I and the erase electrode E are capacitively coupled to the encapsulated ionizable gas (coated with a dielectric layer 11). All of the electrodes, including the input and erase electrodes, are covered in addition with a thin layer of a transparent dielectric 12, typically magnesium oxide. Alternating electrodes on one side of the display panel are connected electrically in separate groups. That is, electrodes numbered $1_1$, $1_2$, $1_3$, etc., are connected together to a terminal 1 while those numbered $3_1$, $3_2$, $3_3$, etc. are connected to a terminal 3. In like manner, on the opposite side, all electrodes numbered $2_1$, $2_2$, $2_3$, etc. are connected to terminal 2 and those numbered $4_1$, $4_2$, $4_3$, etc. are connected to terminal 4. Terminals 1, 2, 3, 4 can be connected through a suitable switch (not shown) to a suitable voltage source (not shown) for sequentially applying voltage pulses to each of the transfer electrodes.

Typically, according to this invention, the input electrode is made of the same conductive material as the transfer electrodes and is directly coupled to the encapsulated ionizable gas. Although metal or carbon may be used for forming the conductive base of the input and transfer electrodes, one conventional material that has been found to work very well is a paste consisting of 50–95% by weight silver and 50–5% by weight glass frit. This material, when fired, provides a conductive metallic electrode due to the silver particles dispersed in the glass matrix with the glass serving to adhere the silver to the substrate.

Figure 1:
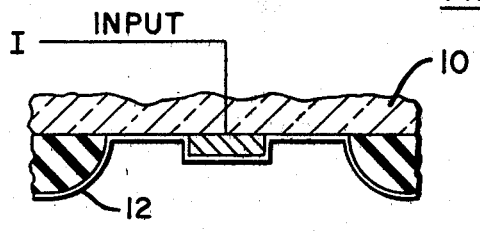
FIG. 1 PRIOR ART
FIG. 1 is a schematic cross-sectional view of a conventional direct-coupled input electrode in a plasma charge transfer display device.
Figure 3:
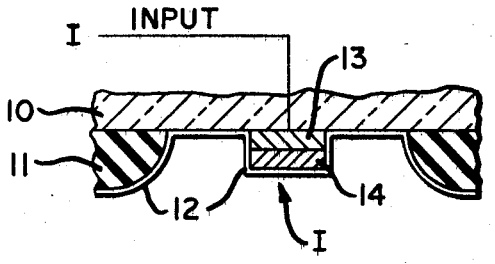
FIG. 3 is a schematic cross-sectional view of an input electrode incorporating the principles of the present invention.
Figure 4:
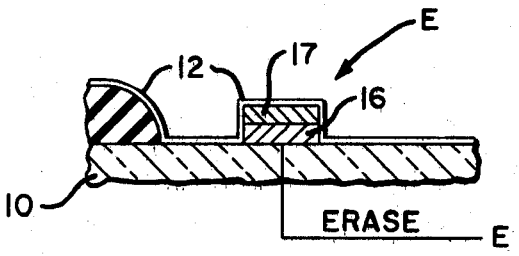
FIG. 4 is a schematic cross-sectional view of an erase electrode incorporating the principles of the present invention.

In prior art devices, the input and erase electrodes shown respectively in FIGS. 1 and 2 were bare except for the thin magnesium oxide coating 12 applied over them. In a preferred embodiment of the present invention, shown in FIGS. 3 and 4, a coating 14 is applied between the conductive base 13 of the input electrode I and the magnesium oxide dielectric layer 12 and coating 17 is applied between the conductive base 16 of the erase electrode E and magnesium oxide layer 12. This coating 14 (and 17) is a slightly conductive metal oxide having a high electrical resistivity.

To determine the upper limit of the desirable surface electrical resistivity of the coating 14, (and 17) consider a typical plasma display panel for which the time (t) between voltage pulses applied to the input electrode is 80 us and which has an input electrode of width, w, of 6 mils (150 microns) and length, h, of 30 mils (750 microns) whose capacitance, C, is typically 0.55 pf. Assume that it is desired that the partially conductive coating on the input be such that the time between pulses represents three time constants. In other words, $t=3T$ or $R=t/3C$ where T is the time constant and R is the resistance of the coating. Since, by definition, $R=KL/wh$ where K is the bulk resistivity of the coating material and L is the thickness of the coating over the input electrode, this yields a bulk resistivity $K=wht/3CL=2.2\times10^{10}$ ohm-mil ($5.6\times10^{11}$ ohm-microns) for a 0.4 mil (10 microns) thick layer, or a sheet resistivity of $5.5\times10^{10}$ ohms per square. This represents the maximum possible sheet resistivity of the coating 14 (and 17) in order to premove the charge on the input electrode before the next voltage pulse is applied to the input electrode. Different values for t, T, etc. would, of course, change the value of the maximum acceptable surface resistivity.

A preferred example of a suitable material for coatings 14 and 17 is a ruthenium oxide-based resistor paste. Formula No. 600-105 sold by Thick Film Systems Inc., Santa Barbara, Calif. This paste, having an unfired viscosity at 25° C. of 750±150 poise, when fired at a temperature of about 600° C. is believed to become essentially glass but nevertheless has a finite small conductivity due to the ruthenium oxide material dispersed within the glass. The ruthenium oxide conductive coating not only preserves the D.C. input characteristics of the device, but also eliminates contamination of the magnesium oxide by the input electrode. A suitable pre-fired thickness of the ruthenium oxide-based material 14, 17 is in the range of 10–30 microns. While the preferred thickness of the coating is believed not limited to the above mentioned range, the stability and operational characteristics of the display device were found to be the same when ruthenium oxide coating of the above thickness range was used.

The above-described ruthenium oxide coating is rated as having a sheet resistivity of approximatey 1 megohm per square when fired at a temperature of 600° C. Although no precise values of resistivity are available, it is estimated that the ruthenium oxide coating resistivity resulting from the exemplary 575° C. firing temperature is about 10 megohms per square. Both values are well below the established upper limit of about $5.5\times10^{10}$ ohms per square.

Other metal oxides that may be used for the coating 14 are resistor pastes made from oxides of thallium, palladium, iridium, indium, tungsten, tantallum, rhodium, copper, bismuth, and lead.

The erase electrode E (FIG. 4) at the other end of the display panel is used to clear the display. The erase electrode in the present embodiment, like the input electrode I, is directly coupled to the encapsulated gas by means of the metallic oxide coating 17 applied between the bare erase electrode conductive base 16 and the magnesium oxide film 12. The above discussion of the metallic oxide coating for the input electrode applies to the erase electrode as well and the preferred metal oxide is also the ruthenium oxide-based material.

Typically, a display panel has several parallel channels 8 running in a horizontal direction along the panel length. Each channel has its own input and erase electrodes; the erase electrodes are connected together since no unique selection is required at the erase electrode. The several channels 8 generally share the same 1, 2, 3, 4 pattern of transfer electrodes.

In construction of such a plasma charge transfer device, all of the electrodes $1_1$, $2_1$, $3_1$, $4_1$, etc. including the input electrode I (conductive base 13 thereof) and the erase electrode E (conductive base 16 thereof) can be formed on the substrate walls 10—10, by using a silk screening technique to pattern the electrodes and then firing the "green" electrode material. Another conventional method of forming the electrodes is by a photoresist technique in which the conductive pattern is achieved by etching away a conductive coating applied on the inner surface of each of the substrate walls 10—10. Next, all of the electrodes except the input and erase electrodes are covered with the dielectric layer 11. The input and erase electrodes are then separately covered with the metallic oxide layer which is fired preferably at 575° C. to form layers 14, 17 for the input and erase electrodes. Over all of the electrodes and their respective coating materials, the dielectric layer 12 is formed to ultimately form an enclosure to contain the ionizable medium. The two substrates 10—10 are then aligned and joined to the substrate by heat treatment. An exhaust port in one of the substrates is utilized to evacuate the cavities, i.e., channels 8, and thereafter an ionizable gas is introduced therein, and the device sealed.

Operation of plasma panels 20 is well-known in the art, see for example U.S. Pat. No. 3,781,600 issued to William E. Coleman and Clarence W. Kessler, and will be but briefly described here. In actual operation of the device, a keep-alive cell is formed by the pair of keep-alive electrodes 6—6 which are capacitively coupled to the gas. The electrodes 6—6 are connected to a source 18 of alternating pulse voltage of suitable magnitude to ionize the gas within the keep-alive cell for facilitating "firing" or discharge of the first cell formed by the input electrode I and the first electrode $1_1$. The device is serially addressed by applying suitable voltage pulses to the input electrode and/or the electrode $1_1$. When the potential between the input electrode I and the first transfer electrode $1_1$ is above a threshold (or firing) voltage, $V_i > V_f$ (where $V_i$ is the potential difference between the input and the first electrode, and $V_f$ is the cell firing voltage), a gaseous discharge occurs. This discharge between the input and the first electrode is quickly extinguished, however, because the trapped charge (or wall charge, as is conventionally known) on the electrode $1_1$ gives rise to a voltage $V_{wc}$ opposing the initially applied voltage. Next, a voltage $V_s$ is applied between the first and second transfer electrodes, $1_1$ and $2_1$ respectively. When $V_s$ of suitable polarity is applied to the first and second transfer electrodes, $V_{wc}$ adds algebraically such that the total voltage between the two is greater than the firing voltage $V_f$ and a gaseous plasma discharge occurs. It should be noted that if no discharge had occurred in the first cell I-$1_1$, no trapped charge would be present on the electrode $1_1$. Then, when $V_s$ is applied between the first and second electrodes, no gaseous plasma discharge would occur in the cell $1_1$-$2_1$. By sequentially applying $V_s$ to successive cells and thus utilizing the trapped charge on the electrode wall of the previously-discharged cell, this charge and the trapped charge initiated by the input pulse can be transferred to any cell along the length of the plasma charge transfer device.

Focusing now on the novel aspects of this invention, the slightly conductive metal oxide coating 14 on the input electrode enables direct electrical connection of the input electrode I to the encapsulated gas without the previous contamination problems. This is possible because the metal oxide coating functions both as a highly resistive protective cover, and also, in a limited sense, as a conductor. That is, when a potential suitable for inputting charge is applied to the input electrode such that $V_i > V_f$ and therefore a plasma discharge is initiated in cell I-$1_1$, the conductive coating 14 dissipates any undesirable charge buildup on the input electrode in time for the next voltage pulse to be applied to the input. However, the coating 14 has sufficient resistivity to give rise to only a slight current through the coating and thereby reduce the possibility of breakdown of the overlying protective magnesium oxide coating on the input electrode.

The conductive coating 17 on the erase electrode enables direct electrical connection of the erase electrode E to the encapsulated gas, like the input electrode I, without the previous contamination problems. Upon discharge of the next to the last cell in the device (the cell formed by the electrodes $3_n$-$4_n$ adjacent the erase electrode E), wall charge is formed on the wall of the electrode $4_n$. Then, upon discharge of the last cell, $4_n$-E, the wall charge is transferred to the erase electrode which, being maintained at the relatively low or ground voltage, extinguishes the discharge. The high resistivity coating 17 dissipates undesirable charge build up on the erase electrode and protects the overlying magnesium oxide coating in the same manner as explained in connection with the input electrode coating 14.

Having described what is considered to be a preferred embodiment of the invention, it will be understood that various changes and modifications may be made in the above-described construction without departing from the spirit thereof, particularly as defined in the following claims.

I claim:

1. An improved plasma transfer display device comprising:

at least one envelope defining a channel containing an ionizable medium; and an electrode located within said channel for initiating or terminating a plasma discharge of the ionizable medium proximate the electrode, said electrode comprising a conductive base a layer of magnesium oxide and a dielectric coating consisting essentially of a ruthenium oxide in a glass matrix and having a sheet resistivity of less than about 10 megohms per square formed between said conductive base and said magnesium oxide layer, said dielectric coating permitting direct coupling of the electrode with the ionizable medium and preventing contamination and breakdown of said magnesium oxide layer by said electrode during operation of the device.

2. A contamination-resistant, voltage breakdown-resistant electrode for a gaseous discharge device for initiating or terminating said discharge, comprising:

a conductive base;

a dielectric layer formed on the conductive base consisting essentially of ruthenium oxide in a glass matrix and having a sheet resistivity of less than about 10 megohms per square, said dielectric permitting direct coupling of said electrode with the gas; and a magnesium oxide dielectric layer formed on said ruthenium oxide dielectric layer.

* * * * *